United States Patent [19]

Onishi et al.

[11] Patent Number: 4,474,872

[45] Date of Patent: Oct. 2, 1984

[54] METHOD FOR PRODUCING PHOTOGRAPHIC EMULSION

[75] Inventors: Hiroshi Onishi; Kazutoshi Inada; Nobuaki Miyasaka; Naoyasu Deguchi; Masayuki Kuroishi, all of Kanagawa, Japan

[73] Assignee: Fuji Photo Film Co., Ltd., Kanagawa, Japan

[21] Appl. No.: 450,610

[22] Filed: Dec. 17, 1982

[30] Foreign Application Priority Data

Dec. 17, 1981 [JP] Japan ..... 56-204152

[51] Int. Cl.[3] ..... G03C 1/84

[52] U.S. Cl. ..... 430/512; 430/518; 430/527; 430/546; 430/559; 430/566; 430/570; 430/599; 430/606; 430/607; 430/621; 430/569

[58] Field of Search ..... 430/570, 607, 546, 559, 430/599, 621, 512, 527, 606, 566, 518, 569

[56] References Cited

U.S. PATENT DOCUMENTS 4,006,025 2/1977 Swank et al. ..... 430/567
4,140,530 2/1979 Trunley et al. ..... 430/546
4,146,399 3/1979 Trunley et al. ..... 430/546
4,284,709 8/1981 Tomka ..... 430/546
4,291,113 9/1981 Minamizono et al. ..... 430/546

FOREIGN PATENT DOCUMENTS 1570362 7/1980 United Kingdom .

*Primary Examiner*—J. Travis Brown
*Attorney, Agent, or Firm*—Sughrue, Mion, Zinn, Macpeak & Seas

[57] ABSTRACT

A method for producing a photographic emulsion is disclosed. The method includes the process of adding a dispersion of a substantially water-insoluble photographic additive to a photographic emulsion. The dispersion being prepared merely by mechanically grinding and dispersing the photographic additive in a form of fine grain having a size of 1μ or less in an aqueous system adjusted to a pH value of 6 to 8 and controlled to a temperature of 60° to 80° C. The additive is included in the photographic emulsion without the need of an organic solvent. The emulsion of the invention can be easily and quickly coated to form a uniform layer.

12 Claims, 2 Drawing Figures

METHOD FOR PRODUCING PHOTOGRAPHIC EMULSION

FIELD OF THE INVENTION

This invention relates to a method for producing a photographic emulsion and, more particularly, to a method for producing a photographic emulsion capable of providing desired photographic properties by merely mechanically dispersing substantially water-insoluble photographic additives in water without using any organic solvents.

BACKGROUND OF THE INVENTION

Previously, the adding of various kinds of water-insoluble photographic additives to a photographic emulsion has been done by dissolving the additives in an organic solvent such as methanol. The resulting solution is then added to a silver halide emulsion. However, the use of an organic solvent in such a method causes the problem that condensates are produced in the photographic emulsion, and is attended with the defect that massive and streaky coating troubles are caused when the photographic emulsion is coated.

Instead of using such a conventional method, a method has been attempted in which an aqueous dispersion is prepared by dispersing photographic additives into an aqueous solution system in the presence of a wetting agent or a dispersing agent without using any organic solvents and the resulting dispersion is added to a silver halide emulsion.

For instance, Japanese Patent Application (OPI) No. 110012/77 (corresponding to British Pat. No. 1,570,362) (the term "OPI" as used herein refers to a "published unexamined Japanese patent application") discloses a process wherein a sensitizer is ground to fine grains in an aqueous phase in the presence of a dispersing agent having a definite surface tension (surface active agent), water is removed from the aqueous dispersion obtained, the resulting matter is dried and then added to a silver halide emulsion as it is or after it is dispersed in water or a gelatin aqueous solution.

Japanese Patent Application (OPI) No. 102733/78 (corresponding to U.S. Pat. No. 4,140,530) describes a method wherein a homogeneous mixture comprised of finely granulated photographic additives, a dispersing agent such as sorbitol, gelatin and so on (paste mixture) is prepared. The mixture is molded in the form of noodle, and dried with hot air to obtain a granulated matter. The granulated matter obtained is, then, added to a photographic aqueous colloid coating composition.

U.S. Pat. No. 4,006,025 describes a method wherein a spectral sensitizing dye is mixed with water to make a slurry. The resulting slurry is heated to a temperature of 40° to 50° C. and dispersed homogeneously into water in the presence of a surface active agent using a homogenizer or a milling machine. The thus obtained dispersion is then added to a silver halide emulsion.

Although these addition methods each relates to a method of dispersing photographic additives (such as spectral sensitizing dyes) in an aqueous system without using any organic solvents, in practice the methods have the following problems. Since an aqueous dispersion is powderized by a freeze-drying technique or the like, the time required to make photographic additives (such as spectral sensitizing dyes) adsorb on silver halide grains is elongated. Accordingly, the desired photographic sensitivity cannot be attained in a short time.

Further, such an emulsion will frequently cause coating troubles due to precipitates, if it is ever coated. In addition, a wetting agent or a dispersing agent used at the time of dispersion of photographic additives causes the destruction of an emulsified matter present in a silver halide emulsion, has adverse effects on the high speed coatability of the silver halide photographic emulsion (for example, causes an increase in coating trouble) and, further, causes deterioration of adhesiveness among constituent layers of the silver halide photographic material produced and in its turn, leads to the manufacture of undesirable products.

SUMMARY OF THE INVENTION

A principal object of this invention is to provide a method for producing a photographic emulsion (for example, a silver halide emulsion and a hydrophilic colloid emulsion) which does not have the above-described defects. That is, an object of this invention is to provide a method for producing a photographic emulsion by dispersing substantially water-insoluble photographic additives into an aqueous system without using any wetting agent or dispersing agents at all which have so far been considered to be indispensible when no organic solvents are employed in such a dispersing process.

As a result of various examinations, it has now been found that the above-described object can be attained with the following method.

That is, this invention comprises a method of adding a dispersion of substantially water-insoluble photographic additives to a photographic emulsion, with the dispersion being prepared by mechanically grinding and dispersing such photographic additives in the form of finely divided particles having sizes of 1μ or less in an aqueous system under the condition that the pH of the aqueous system is adjusted to 6 to 8 and the temperature thereof is controlled to 60° to 80° C.

In other words, this invention relates to the discovery that the above-described method unexpectedly permits the preparation of photographic emulsions free from the above-described defects. The method can be performed even though a wetting agent or a dispersing agent has so far been considered to be essential for mechanically grinding and dispersing of substantially water-insoluble photographic additives (such as spectral sensitizing dyes) in an aqueous solvent system.

Those skilled in the art have so far imagined that serious problems are caused by raising the temperature of an aqueous dispersion system of water-insoluble photographic additives. In addition to being unstable in an aqueous solution system, it was believed that water-insoluble photographic additives themselves are decomposed when allowed to stand under a high temperature condition and, therefore, intended photographic properties cannot be obtained. It was further believed that the viscosity of a solution system is decreased by raising the temperature and therethrough the grinding efficiency and the dispensing efficiency of a solid are sharply decreased. However, contrary to the beliefs of those skilled in the art, it has now been discovered that highly effective dispersions can be achieved under the above-described conditions.

DETAILED DESCRIPTION OF THE INVENTION

Figure 1:
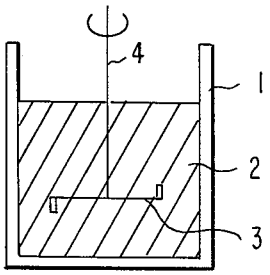
FIG. 1 is a schematic cross-section diagram of a high speed agitation type dispersing machine, wherein numeral 1 designates a tank, numeral 2 designates a dispersion, and numeral 3 designates a dissolver.

Mechanical grinding and dispersion of substantially water-insoluble photographic additives can be effectively carried out when the pH value and a temperature of the aqueous system to be used are controlled to 6° to 8° and 60° to 80° C., respectively. More preferably, the pH is adjusted within the range of 6.5 to 7.5, and the temperature is controlled within the range of 65° C. to 75° C. The pH is adjusted using a pH modifier such as potassium hydroxide, sodium hydroxide, acetic acid, phosphoric acid, sulfuric acid, etc.

Substantially water-insoluble photographic additives dispersed in accordance with the method of this invention are in the form of finely divided particles measuring 1μ or less (more specifically 0.1μ to 1μ), in mean particle size.

The terms "substantially water-insoluble" used in this invention means that the solubility of the photographic additive in water at 20° C. is 1 wt% or less, more specifically 0.1 wt% or less.

The substantially water-insoluble photographic additives which can be employed in this invention are solid additives. Specific examples of which include spectral sensitizing dyes, antifoggants, color couplers, dyes, sensitizers, hardeners, ultraviolet absorbing agents, antistatic agents, brightening agents, desensitizers, developers, discoloration inhibitors, mordants and so on.

These additives are described in *Research Disclosure,* Vol. 176, RD-17643, pages 22 to 31 (December 1978).

Suitable examples of the spectral sensitizing dyes include methine dyes and styryl dyes, such as cyanine dyes, merocyanine dyes, hemicyanine dyes, rhodacyanine dyes, oxonol dyes, hemioxonol dyes and the like. Among these dyes, anionic dyes, such as those which have as their substituents one, but preferably two or more, sulfo groups or sulfoalkyl groups, and the like, have greater effects.

Besides the spectral sensitizing dyes described in the above-described publication, those which are described in the following patent specifications can be employed. Examples of such patent specifications include German Pat. No. 929,080, U.S. Pat. Nos. 2,493,748, 2,503,776, 2,519,001, 2,912,329, 3,656,959, 3,672,897, 3,694,217, 4,025,349, 4,046,572, 2,688,545, 2,977,229, 3,397,060, 3,522,052, 3,527,641, 3,617,293, 3,628,946, 3,666,480, 3,672,898, 3,679,428, 3,703,377, 3,814,609, 3,837,862 and 4,026,707 (these U.S. patents being incorporated herein by reference to disclose such spectral sensitizers), British Pat. Nos. 1,242,588, 1,344,281 and 1,507,803, Japanese Patent Publication Nos. 14030/69, 24844/77 (corresponding to U.S. Pat. No. 3,982,950), Nos. 4936/68 and 12375/78, Japanese Patent Application (OPI) No. 110618/77 (corresponding to U.S. Pat. No. 4,152,163), No. 109925/77 (corresponding to British Pat. No. 1,547,045) and No. 80827/75 (corresponding to U.S. Pat. No. 3,955,996), and so on.

Examples of additives other than the spectral sensitizing dyes which may be used include benzotriazole compounds, 4-thiazolidone compounds, benzophenone compounds, cinnamate compounds, butadiene compounds, benzoxazole compounds, cationic polymers, chromium salts, aldehydes, N-methylol compounds, dioxane derivatives, active vinyl compounds, active halogen compounds, mucohalic acids, nitroindazoles, triazoles, benzotriazoles, benzimidazoles, mercaptothiazoles, mercaptobenzothiazoles, tetraazaindenes, 5-pyrazolone couplers, pyrazolobenzimidazole couplers, acylacetamide couplers, naphthol couplers, phenol couplers, and so on.

In order to mechanically grind and disperse photographic additives in an aqueous system, various kinds of dispersing machines can be effectively used. Specific examples of dispersing machines which can be used in this invention include a high speed agitator, a ball mill, a sand mill, a colloid mill, an attriter, an ultrasonic dispersing machine and so on. Preferred dispersing machine is a high speed agitator.

Figure 2:
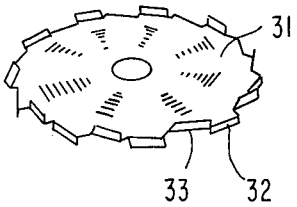
FIG. 2 is an illustration of a dissolver, wherein numeral 31 designates an impeller, and numerals 32 and 33 designate blades.

A typical example of a high speed agitator is shown in FIG. 1. The agitator is comprised of a tank 1, a dissolver wing 3 and a vertical shaft 4. FIG. 2 shows the dissolver 3. The dissolver comprises an impeller 31 having positioned thereon alternating saw-toothed blades 33 bent upwards and saw-toothed blades 32 bent downwards at the extremity thereof. The impeller 31 is fixed to the end of a vertical shaft rotating at high speed in the center of a tank having an approximately cylindrical form. A suitable ratio of the diameter of the impeller to the inside diameter of the tank ranges from about 1:5 to about 2:5. A suitable ratio of the diameter of the impeller to a gap between the impeller and the bottom of the tank ranges from about 2:1 to about 1:1. The ratio of the diameter of the impeller to the depth of the stationary liquid in the tank preferably ranges from about 1:1 to about 1:3.

Suitable examples of high speed agitators which can be used in this invention may further include that which has a dissolver constructed by plural impellers fitted round one vertical shaft, and that which has a multi-shaft dissolver fitted with plural vertical shafts. Besides the high speed agitators equipped with dissolvers alone, high speed agitators having both a dissolver and an anchor wing are employed to greater advantage.

A dispersion obtained in this invention may be directly added to a photographic emulsion (for example, a silver halide emulsion and a hydrophilic colloid emulsion) as it is, or after being mixed with a protective colloid the resulting mixture, whether it is in a liquid state or in a gelled state, may be added to a photographic emulsion (for example, a silver halide emulsion and a hydrophilic colloid emulsion). In all the cases, sufficient photographic properties can be obtained.

In addition, after a dispersion obtained in this invention is mixed with a protective colloid, the resulting mixture can be stored for a long time under a temperature of 30° C. or below, or in a refrigerator. The preserved mixture can be taken out when the occasion demands and added to a silver halide emulsion.

Examples of protective colloids which can be employed for the above-described purpose may include all of hydrophilic protective colloids, specifically gelatin, carboxymethyl cellulose, cellulose sulfate, polyvinyl alcohol and so on. Of these protective colloids, gelatin is the most favorable one.

A protective colloid to be added to the dispersion of this invention may be present in a state of aqueous solution or solid. In addition, at the time of adding a protective colloid to the dispersion of this invention, antiseptics may optionally be employed.

The amount of substantially water-insoluble photographic additives to be added to the photographic emulsion can be varied depending upon the kind of the additive employed. When the dispersion of the substantially water-insoluble photographic additives is added to a silver halide emulsion, the amount of the additive can be varied depending upon the amount of silver halide contained in the emulsion and so on. In general, a suitable amount is equal to those conventionally used.

Examples of silver halides which can be employed in this invention include silver bromide, silver iodobromide, silver iodochlorobromide, silver chlorobromide, silver chloride and so on. The silver halide is not specifically limited with respect to grain size. However, grain sizes of 3μ or below are desirable. These silver halide emulsions can be prepared with ease using various methods as described in P. Glafkides, *Chimie et Physique Photographique,* Paul Montel, Paris (1967); G. F. Duffin, *Photographic Emulsion Chemistry,* The Focal Press, London (1966); V. L. Zelikman et al., *Making and Coating Photographic Emulsion,* The Focal Press, London (1964), and so on.

Useful methods described in the above cited publications include the acid method, the neutral method and the ammonia method. Suitable methods for reacting a water-soluble silver salt with a water-soluble halide include a single jet method, a double jet method, a combination thereof, and so on.

A method in which silver halide grains are produced in the presence of excess silver ion (the so-called reverse mixing method) can be employed. Further, it is possible to use the so-called controlled double jet method, in which the pAg of the liquid phase wherein silver halide grains are to be precipitated is maintained constant. According to this method, a silver halide emulsion having a regular crystal form and nearly uniform grain sizes can be obtained.

A mixed emulsion prepared by mixing two or more of silver halide emulsions made separately may also be employed.

In a process of producing silver halide grains or allowing the produced silver halide grains to ripen physically, cadmium salts, zinc salts, lead salts, thallium salts, iridium salts or complexes, rhodium salts or complexes, iron salts or complexes, and/or the like may be present.

In addition to the above-described salts, various additives can be employed in photographic emulsions which can be used in this invention. Namely, sensitizers such as sulfur sensitizers, reduction sensitizers, noble method sensitizers and so on, stabilizers, surface active agents, hardeners, thickeners, dyes, ultraviolet absorbing agents, antistatic agents, brightening agents, desensitizers, developers, discoloration inhibitors, mordants and so on can be employed. In addition, dispersions of couplers like color couplers in oils can be employed.

These additives are concretely described in *Research Disclosure,* Vol. 176, RD-17643, pages 22 to 31 (December 1978), T. H. James, *The Theory of The Photographic Process,* 4th Ed., Macmillan Publishing Co., Inc., New York (1977), and so on.

A suitable binder to be used in silver halide emulsions of this invention is gelatin. However, in addition to gelatin, it is possible to use gelatin derivatives such as phthaloylated gelatin and the like, albumin, agar, gum arabic, cellulose derivatives, polyvinyl acetate, polyacrylamide and polyvinyl alcohol.

In accordance with the production method of this invention, photographic additives are not added in a powdered condition to a silver halide emulsion. Therefore, it becomes unnecessary to spend a long time in adsorbing photographic additives on silver halide grains and, further, coating troubles due to precipitates and the like can be prevented from occurring at the time of coating the emulsion.

In addition, in accordance with the production method of this invention, it becomes feasible to disperse substantially water-insoluble photographic additives into a photographic emulsion without using any wetting agents and/or dispersing agents which have so far been considered to be essential. Therefore, with the present invention it becomes possible to obviate destruction of emulsified substances, adverse effects on high speed coating and other undesirable effects, such as poor adhesiveness among constituent layers of a photographic material obtained, which are attributed to the use of such agents.

Further, in accordance with another embodiment of this invention, a mixed composition may be prepared using a protective colloid. The mixed composition prepared can be stably preserved over a long period of time, specifically a month or longer, by merely cooling it without carrying out any drying procedures and so on.

EXAMPLE 1

10.4 g of the spectral sensitizing dye A of the following structural formula was adding to 285.6 g of distilled water, and the pH of the resulting mixture was adjusted to 7.0 with a 0.1N NaOH aqueous solution. The resulting mixture was divided into several portions, and temperatures of the portions were controlled to 20° C., 35° C., 50° C., 65° C. and 90° C., respectively. Each portion was agitated for 30 to 120 minutes using a high speed agitator (dissolver) as shown in FIG. 1 at 8,000 rpm to obtain a dispersion of the spectral sensitizing dye.

The mean grain size of the spectral sensitizing dye in each of the thus prepared dispersions was measured, and the results obtained are shown in Table 1.

Spectral Sensitizing Dye A

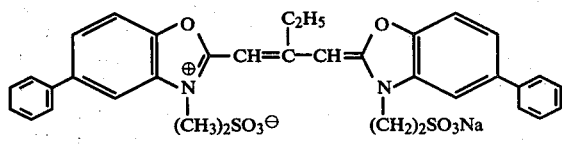

TABLE 1

| Dispersion Time | Mean Grain Size 20° C. (μ) | 35° C. (μ) | 50° C. (μ) | 65° C. (μ) | 90° C. |
|---|---|---|---|---|---|
| 30 min | 170 | 120 | 45 | 10 | Decomposed |
| 60 min | 150 | 75 | 20 | 1.0 | " |
| 90 min | 130 | 50 | 5 | 0.5 | " |
| 120 min | — | 30 | 5 | 0.4 | " |

It should also be noted that it was impossible to reduce the mean grain size to below 5μ under the temperature of 50° C. even if the dispersion procedure was continued over a period of time longer than 120 minutes.

As can be seen from Table 1, it was unexpectedly discovered that when the dispersion temperature was raised to 65° C. the spectral sensitizing dye was ground and dispersed very easily in the form of a fine grain measuring 1μ or less in size. When the dispersion temperatures were 20° C., 35° C. and 50° C., respectively, it was impossible to reduce the grain size to about 1μ regardless of long dispersing procedures were continued. Further, when the dispersion was carried out under a temperature of 90° C., the spectral sensitizing dye was decomposed without being dispersed in a solid state.

The following procedures were carried out using the dispersion A obtained under the condition that the dispersion temperature was 50° C. and the dispersion time was 90 minutes, and the dispersion B obtained under the condition that the dispersion temperature was 65° C. and the dispersion time was 90 minutes. To each of the dispersions was added 1,600 g of a 6.25 wt% gelatin aqueous solution. The resulting mixture was agitated for 30 minutes at 1,000 rpm and then passed through a filter having a pore size of 30μ to obtain a mixed composition. The thus obtained mixed composition was preserved for one month as it was cooled at a temperature of 5° to 7° C. Thereafter, it was added to a silver chlorobromide emulsion (Br content: 70 mol%, grain size: 0.5μ) prepared in a usual manner, coated on a polyethylene terephthalate support and dried. The intended photographic sensitivity was obtained in the silver halide sensitive material produced using the dispersion B. On the other hand, in the silver halide sensitive material produced using the dispersion A, the intended photographic sensitivity was not attained and the sensitivity obtained was significantly lower than that of the former sensitive material.

In addition, even after the mixed composition of the dispersion B was stored for a long time extending over one month in the cooled condition, no decomposed products and no condensates were observed, and the spectral sensitizing dye was unchanged. Further, as for the coatability of the resulting emulsion on a support, no coating troubles due to precipitates and the like were observed and an excellent quality coat was formed.

EXAMPLE 2

10.4 g of the same spectral sensitizing dye A as used in Example 1 was added to 285.6 g of distilled water. The resulting mixture was divided into several portions, and their pH values were adjusted to 5.5, 7.0 and 9.5, respectively, using a 0.1N NaOH aqueous solution. Each of the resulting portions was agitated for dispersion at 65° C. for 120 minutes in the same manner as in Example 1. During the agitation, changes in concentration of the spectral sensitizing dye A added were measured with a spectrophotometer. The results obtained are shown in Table 2.

TABLE 2

| Dispersion Time | Concentration | | |
|---|---|---|---|
| | pH = 5.5 | pH = 7.0 | pH = 9.5 |
| 0 min | 100 | 100 | 100 |
| 30 min | 98.2 | 100 | 97.0 |
| 60 min | 97.0 | 100 | 94.6 |
| 120 min | 94.4 | 99.6 | 93.5 |

The concentration of the spectral sensitizing dye at the time of initiation of dispersion in each pH condition was taken as 100.

Table 2 shows that when the pH was adjusted to 7.0 at the time of dispersion, the concentration of the spectral sensitizing dye was hardly changed by the dispersion procedure. However, when the pH was 5.5 and 9.5, the concentrations of the spectral sensitizing dye were lowered to considerable extents in a short time.

EXAMPLE 3

Dispersion operations were carried out in the same manner as in Example 1 except that the spectral sensitizing dye B or C having the following structural formulae respectively was employed instead of the spectral sensitizing dye A.

Spectral Sensitizing Dye B

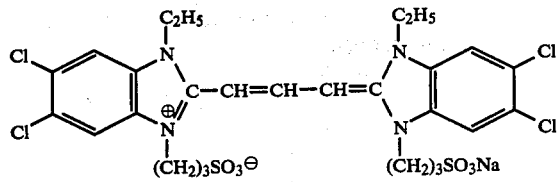

Spectral Sensitizing Dye C

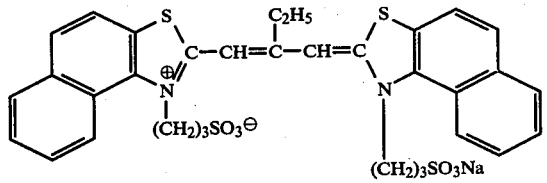

In analogy with the result of Example 1, each of the spectral sensitizing dyes was dispersed in the form of fine grain measuring 1μ or less in size by adjusting the pH value to 7.0, controlling the dispersion temperature to 65° C. and continuing agitation for 60 minutes in the same manner.

In each of the sensitive materials obtained, the intended photographic sensitivity was produced. Further, no coating troubles due to precipitates and the like were observed and the coat formed had an excellent quality.

While the invention has been described in detail and with reference to specific embodiments thereof, it will be apparent to one skilled in the art that various changes and modifications can be made therein without departing from the spirit and scope thereof.

What is claimed is:

1. A method for producing a photographic emulsion, comprising the steps of:

preparing a dispersion by mechanically grinding and dispersing a substantially water-insoluble photographic additive in a form of fine grain having mean particle size of 1μ or less in an aqueous system substantially free of organic solvents and surfactants, the aqueous system being adjusted to a pH value of 6 to 8 and controlled to a temperature of 60° C. to 80° C.; and adding the dispersion to a photographic emulsion.

2. A method for producing a photographic emulsion as claimed in claim 1, wherein the photographic emulsion is a hydrophilic colloid emulsion.

3. A method for producing a photographic emulsion as claimed in claim 1, wherein the photographic emulsion is a silver halide emulsion.

4. A method for producing a photographic emulsion as claimed in claim 1, wherein the substantially water-insoluble photographic additive is selected from the group consisting of a spectral sensitizing dye, an antifoggant, a color coupler, a dye, a sensitizer, a hardener, an ultraviolet absorbing agent, an antistatic agent, a brightening agent, a desensitizer, a developer, a discoloration inhibitor and a mordant.

5. A method for producing a photographic emulsion as claimed in claim 4, wherein the photographic additive is a spectral sensitizing dye.

6. A method for producing a photographic emulsion as claimed in claim 1, wherein the mechanical grinding and dispersing is carried out by means of a high speed agitator.

7. A method for producing a photographic emulsion as claimed in claim 1, wherein after preparing the dispersion the dispersion is mixed with a protective colloid and then added to the photographic emulsion.

8. A method for producing a photographic emulsion as claimed in claim 7, wherein the protective colloid is a gelatin.

9. A method for producing a photographic emulsion as claimed in claim 7, wherein after mixing the dispersion with the protective colloid the mixture is stored at a temperature of 30° C. or less and thereafter added to the photographic emulsion.

10. A method for producing a photographic emulsion as claimed in claim 1, wherein the dispersion is prepared by controlling the temperature within the range of 65° C. to 75° C.

11. A method for producing a photographic emulsion as claimed in claim 1, wherein the dispersion is prepared by maintaining the pH within the range of 6.5 to 7.5.

12. A method for producing a photographic emulsion as claimed in claim 1, wherein the photographic additive is in a form of fine grain having mean particle size of 0.1$\mu$ to 1$\mu$.

* * * * *